US008468811B2

(12) United States Patent
Smith

(10) Patent No.: US 8,468,811 B2
(45) Date of Patent: Jun. 25, 2013

(54) THERMAL DIFFUSER

(75) Inventor: Jeffrey P. Smith, Prosper, TX (US)

(73) Assignee: PACCAR Inc, Bellevue, WA (US)

( * ) Notice: Subject to any disclaimer, the term of this patent is extended or adjusted under 35 U.S.C. 154(b) by 509 days.

(21) Appl. No.: 12/456,870

(22) Filed: Jun. 22, 2009

(65) Prior Publication Data

US 2010/0319333 A1 Dec. 23, 2010

(51) Int. Cl.
*F01N 3/00* (2006.01)

(52) U.S. Cl.
USPC ..... 60/317; 60/320

(58) Field of Classification Search ..... 60/316, 60/317, 319, 324
See application file for complete search history.

(56) References Cited

U.S. PATENT DOCUMENTS

| | | | | |
|---|---|---|---|---|
| 154,203 | A | 8/1874 | Wilkinson | |
| 391,902 | A | 10/1888 | Lemley | |
| 648,801 | A | 5/1900 | Schubert | |
| 1,531,831 | A | 3/1925 | Bartholdi | |
| 1,685,006 | A | 9/1928 | Schultz | |
| 1,955,176 | A | 4/1934 | Dearing | |
| 2,024,834 | A | 12/1935 | Rippe | |
| 2,491,876 | A | 12/1949 | Schoenfeld | |
| 2,514,247 | A | 7/1950 | Leardi | |
| 2,515,467 | A | 7/1950 | Peterson | |
| 2,968,150 | A * | 1/1961 | Goebel et al. | 239/265.37 |
| 3,016,692 | A | 1/1962 | Iapella | |
| 3,060,681 | A * | 10/1962 | Morley et al. | 239/127.3 |
| 4,139,581 | A | 2/1979 | Swanson | |
| 4,175,640 | A | 11/1979 | Birch | |
| 4,222,456 | A | 9/1980 | Kasper | |
| 5,282,361 | A | 2/1994 | Sung | |
| 5,884,472 | A * | 3/1999 | Presz et al. | 60/262 |
| 6,745,562 | B2 | 6/2004 | Berriman | |
| 7,908,848 | B1 * | 3/2011 | Toney | 60/307 |
| 2006/0277901 | A1 | 12/2006 | Allegre | |
| 2007/0163249 | A1 * | 7/2007 | Clerc et al. | 60/320 |
| 2007/0245725 | A1 * | 10/2007 | Brown et al. | 60/317 |
| 2009/0095556 | A1 * | 4/2009 | Eifert et al. | 180/309 |

FOREIGN PATENT DOCUMENTS

| | | | |
|---|---|---|---|
| JP | 55-160116 | A | 12/1980 |
| JP | 8-135438 | A | 5/1996 |

* cited by examiner

*Primary Examiner* — Thomas Denion
*Assistant Examiner* — Patrick Maines
(74) *Attorney, Agent, or Firm* — Christensen O'Connor Johnson Kindness PLLC

(57) ABSTRACT

In a land vehicle of the type having an engine and an exhaust system including an exhaust pipe, a flow diffuser for the exhaust pipe generally includes a substantially tubular body having an outer wall, an interior, and first and second ends, the first end being an exhaust inlet configured to be attachable to an exhaust pipe, the second end being an exhaust discharge portion having an exit plane, a plurality of radial struts extending inwardly from the inner surface of the outer wall to the center of the exit plane for dividing the exhaust discharge portion divided into a plurality of exit channels, and a plurality of air channels extending from the outer wall to the interior of the tubular body configured for delivering air to the interior of the tubular body.

12 Claims, 10 Drawing Sheets
(5 of 10 Drawing Sheet(s) Filed in Color)

THERMAL DIFFUSER

BACKGROUND

New, more stringent emission limits for diesel engines necessitate the use of exhaust after-treatment devices, such as diesel particulate filters. Certain after-treatment devices include a regeneration cycle. During the regeneration cycle, the temperature of the exhaust gas plume may rise significantly above acceptable temperatures normally experienced by exhaust systems without such after-treatment devices. As an example, exhaust systems without after-treatment devices typically discharge exhaust gas at a temperature of around 650 degrees Kelvin. An exhaust system having an after-treatment device that includes a regeneration cycle may experience an exhaust gas plume temperature exceeding 900 degrees Kelvin at its center core. Exhaust gas at this high exit temperature creates a potentially hazardous operating environment.

Prior art and current exhaust pipe diffusers passively feed cooling ambient air directly through the duct wall, but do not optimally intermingle the cooling air with the hot core stream in the center of the exhaust pipe. The result at the exit plane is a cool ring of exhaust flow surrounding a very hot exhaust core.

Thus, there exists a need for a flow diffuser for an exhaust pipe for diffusing hot exhaust gas on exit from an exhaust pipe.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, in a land vehicle of the type having an engine and an exhaust system including an exhaust pipe, a flow diffuser for the exhaust pipe is provided. The flow diffuser generally includes a substantially tubular body having an outer wall, an interior, and first and second ends, the first end being an exhaust inlet configured to be attachable to an exhaust pipe, the second end being an exhaust discharge portion having an exit plane. The flow diffuser further includes a plurality of radial struts extending inwardly from the inner surface of the outer wall to the center of the exit plane for dividing the exhaust discharge portion into a plurality of exit channels. The flow diffuser further includes a plurality of air channels extending from the outer wall to the interior of the tubular body configured for delivering air to the interior of the tubular body.

In accordance with another embodiment of the present disclosure, in a land vehicle of the type having an engine and an exhaust system including an exhaust pipe, a flow diffuser for the exhaust pipe is provided. The flow diffuser generally includes a substantially tubular body having an outer wall, an interior, and first and second ends, the first end being an exhaust inlet configured to be attachable to an exhaust pipe, the second end being an exhaust discharge portion having an exit plane. The flow diffuser further includes a plurality of radial struts extending inwardly from the inner surface of the outer wall to the center of the exit plane for dividing the exhaust discharge portion into a plurality of exit channels, wherein the plurality of radial struts are substantially hollow and include a plurality of air channels extending from a plurality of inlets on the outer surface of the outer wall to a plurality of outlets in the interior of the tubular body.

In accordance with another embodiment of the present disclosure, in a land vehicle of the type having an engine and an exhaust system including an exhaust pipe, a flow diffuser for the exhaust pipe is provided. The flow diffuser generally includes a substantially tubular body having an outer wall, an interior, and first and second ends, the first end being an exhaust inlet configured to be attachable to an exhaust pipe, the second end being an exhaust discharge portion having an exit plane. The flow diffuser further includes a plurality of radial struts extending inwardly from the inner surface of the outer wall to the center of the exit plane for dividing the exhaust discharge portion into a plurality of exit channels, wherein the plurality of radial struts are substantially hollow and include a plurality of air channels extending from a plurality of inlets on the outer surface of the outer wall to a plurality of outlets in the interior of the tubular body, wherein the outlets are located in the interior of the tubular body at least ¼ of the radial distance inwardly from the outer wall of the tubular body.

DESCRIPTION OF THE DRAWINGS

The patent or application file contains at least one figure executed in color. Copies of this patent or patent application publication with color figures will be provided by the Office upon request and payment of the necessary fee.

The foregoing aspects and many of the attendant advantages of this disclosure will become more readily appreciated by reference to the following detailed description, when taken in conjunction with the accompanying drawings, wherein.

DETAILED DESCRIPTION

Figure 1:
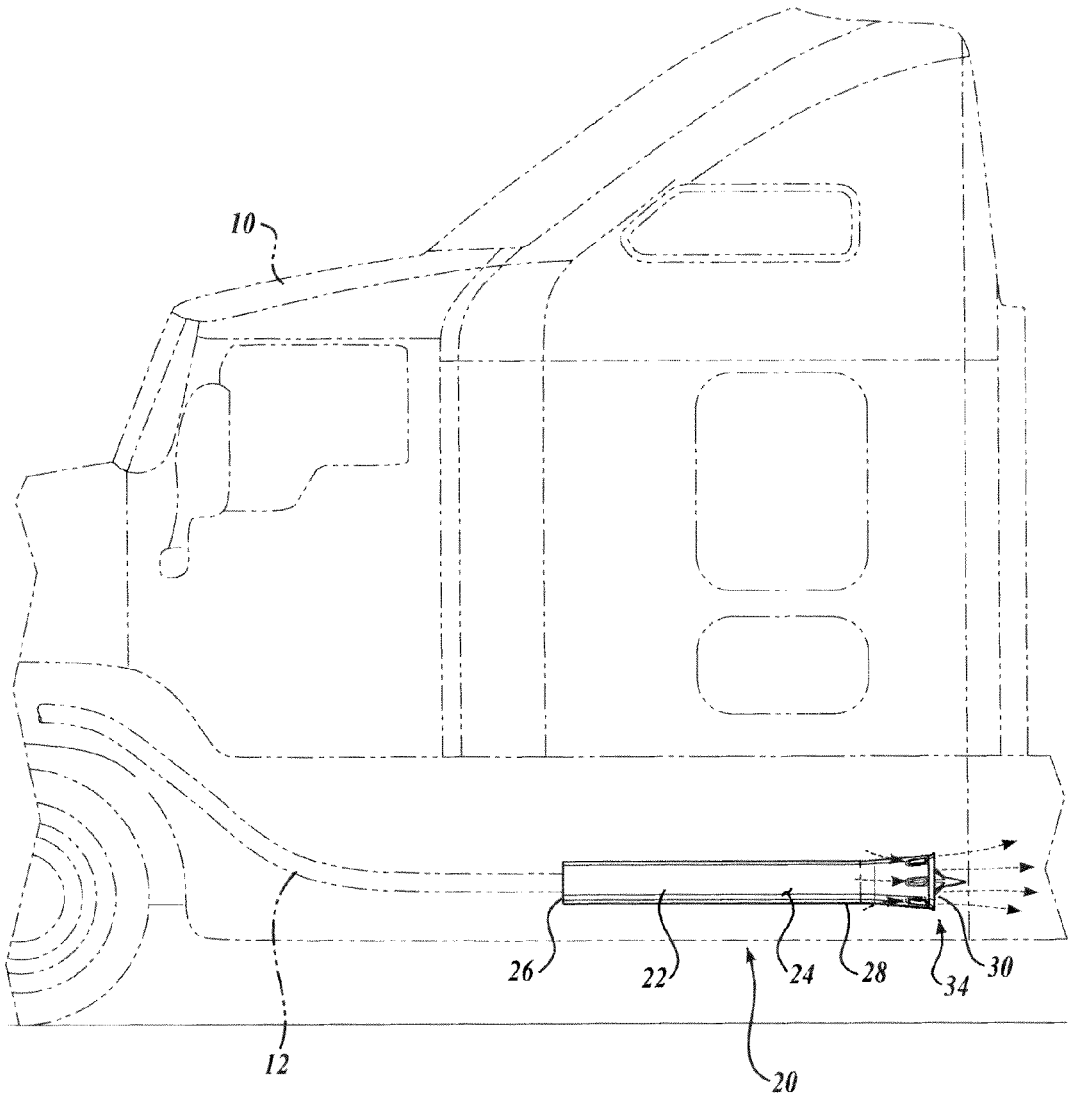
FIG. 1 is a side view of a flow diffuser formed in accordance with one embodiment of the present disclosure, showing the flow diffuser coupled to a vehicle of the type having an engine and an exhaust pipe.
Figure 2:
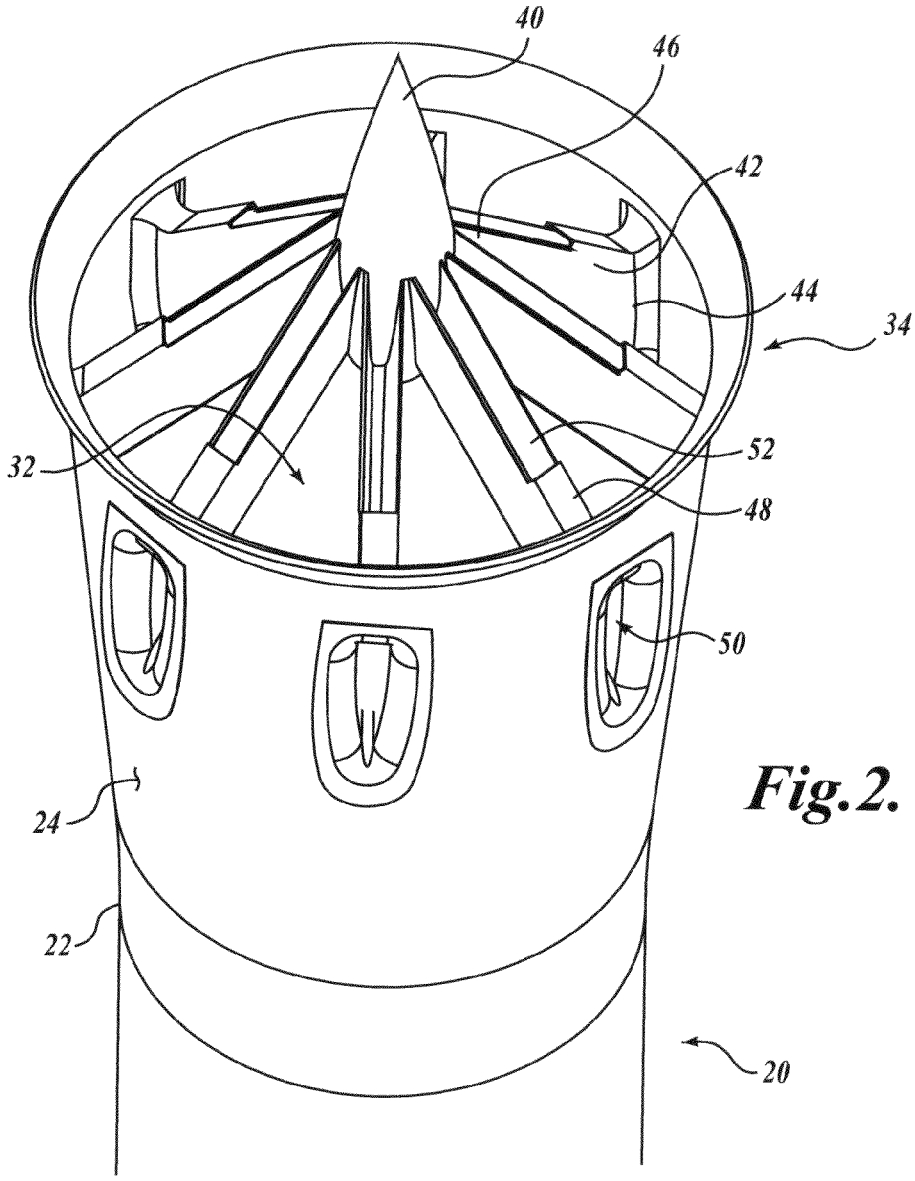
FIG. 2 is a perspective view of the flow diffuser of FIG. 1.

A flow diffuser 20 constructed in accordance with one embodiment of the present disclosure may be best understood by referring to FIGS. 1 and 2. The flow diffuser 20 includes a substantially tubular body 22 having an outer surface 24 and first and second ends 26 and 28. The first end 26 is configured for attachment to an exhaust pipe 12. The second end 28 includes a diffusion portion 30 having at least one diffusion port 32 and an optimized flow configuration for heat dissipation. During the operation of a vehicle, for example, the vehicle 10 shown in the illustrated embodiment of FIG. 1, exhaust gas travels through an exhaust pipe 12 and is diffused to the surrounding ambient air by the flow diffuser 20.

Flow diffusers 20 of the present disclosure reduce temperature and velocity profiles of hot exhaust gas plumes after exiting an exhaust pipe to reduce the risk of danger associated with hot exhaust pipe discharge. As discussed in greater detail below, specifically, with reference to EXAMPLES 1-3 below, the flow diffusers described herein promote ready mixing and diffusion of hot exhaust gas with cooler surrounding ambient air for heat dissipation. Moreover, the embodiments described herein are also configured such that the combined flow area of the diffusion ports 32 is equal to or greater than the flow area of the inlet or first end 26 to maintain or reduce exhaust gas velocity at the diffusion ports 32 and prevent back pressure within the flow diffuser 20.

Although illustrated and described in conjunction with under-chassis exhaust pipes, other configurations, such as vertical (i.e., stack) exhaust pipes, are also intended to be within the scope of the present disclosure. In a stack exhaust pipe application, exhaust gas diffusion is important to prevent combustion of ignitable objects nears the stack, such as a bridge, tree, etc. It should be appreciated that the first end 26 is an inlet, connectable to the exhaust pipe 12 (see FIG. 1) by any means known to those having ordinary skill in the art, including by an interference fit, welding, or any suitable fastening devices, such as bolts, rivets, or other fasteners.

Figure 3:
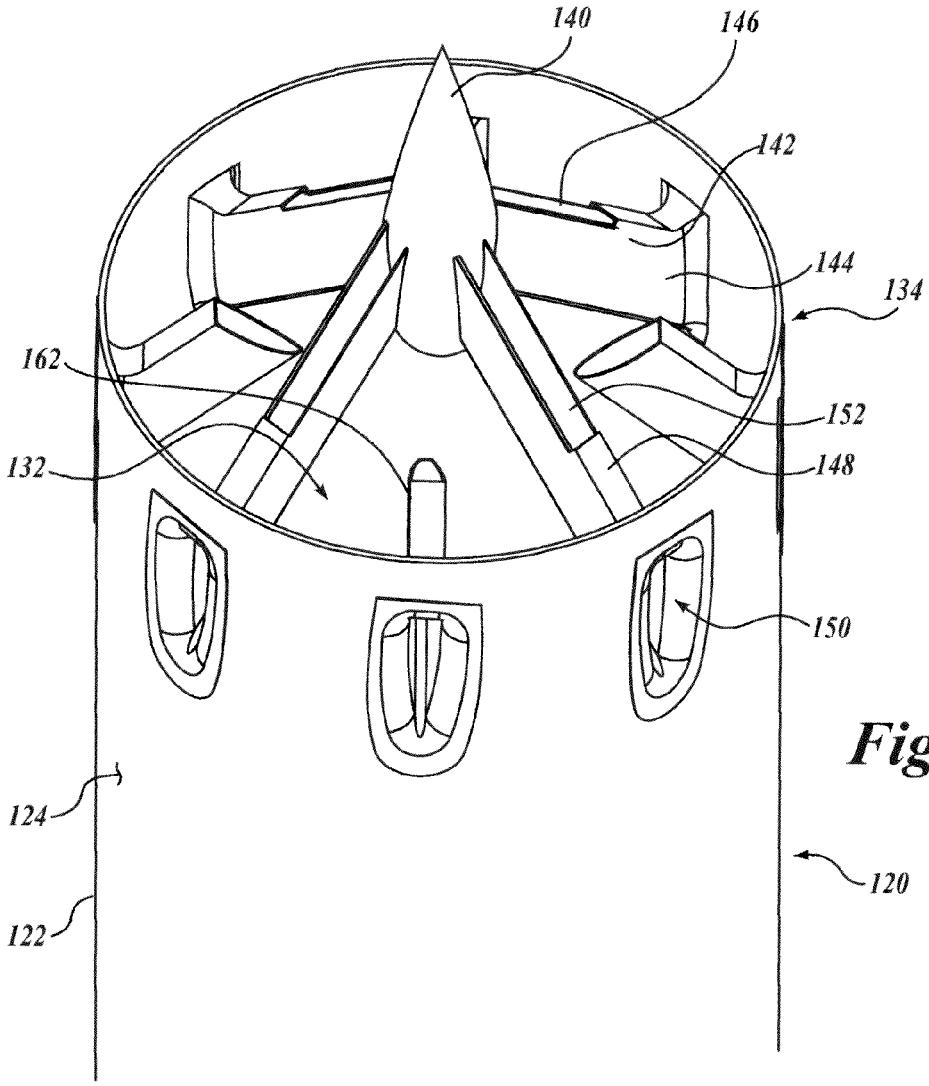
FIG. 3 is a perspective view of flow diffuser for an exhaust pipe formed in accordance with other embodiments of the present disclosure.

In the illustrated embodiment of FIGS. 1 and 2, the flow diffuser 20 is coupled to an exhaust pipe 12, for example, a 5-inch diameter nominal pipe having a circular cross section. In the illustrated embodiment, the flow diffuser 20 has a flared end, for example, a 5-degree flare from a 5-inch diameter to a 7-inch diameter to increase the cross-sectional area of the second end 28 of the flow diffuser 20. However, it should be appreciated that the flow diffuser may also have a substantially uniform cross-sectional area from the first end 26 to the second end 28 (see, e.g., FIG. 3).

As mentioned above, the flow diffuser 20 includes at least one diffusion port 32 having an exit plane 34 for exhaust gases to exit the flow diffuser 20. In the illustrated embodiment, the flow diffuser 20 includes a flow diverter 40, such as a plug, at or near the exit plane 34. The flow diverter 40 is designed to physically interrupt the core stream in the center of the exhaust pipe 12 and flow diffuser 20 and promote turbulence in the exhaust stream for fluid mixing and heat dissipation. In the illustrated embodiment, the flow diverter 40 is located along the center longitudinal axis of the flow diffuser 20 at or near the exit plane 34; however, it should be appreciated that the flow diverter 40 need not be centered along the longitudinal axis of the flow diffuser at or near the exit plane 34. In that regard, the placement of the flow diverter 40 may be used to direct exhaust gas from the flow diffuser 20. For example, if positioned on the vehicle as shown in FIG. 1, it may be advantageous to position the flow diverter toward the top of the flow diffuser 20 to direct exhaust gas backwardly and downwardly away from areas of concern, such as the vehicle chassis, wiring, or cab. In addition, it should be appreciated that the flow diffuser 20 may include more than one flow diverter 40 in the exit plane 34.

The flow diffuser 20 further encourages exhaust stream mixing by introducing flow dividers 42, or struts, to further break up the hot exhaust gases and also to draw in cooling ambient air into the exhaust stream to encourage mixing at the exit plane 34. In that regard, as seen in the illustrated embodiment, the flow diverter 40 is surrounded by a plurality of radial struts 42 connected to the second end 28 of the flow diffuser 20. The struts 42 divide the exhaust diffusion portion 30 of the flow diffuser 20 into a plurality of diffusion ports 32.

In the illustrated embodiment, the struts 42 have first and second ends 44 and 46, which extend from an interior surface of the tubular body 22 of the flow diffuser 20 to the center axis of the flow diffuser 20, meeting near the longitudinal axis of the flow diffuser 20, e.g., at or near the flow diverter 40 (or center plug). The struts 42 are positioned in an obtuse angular relationship to the tubular body 22. In the illustrated embodiment, eight struts 42 are shown; however, it should be appreciated that any number of struts are within the scope of the present disclosure, including, but not limited to three, four, five, six, seven, eight, or more. Moreover, it should be appreciated that the struts need not all be of equal length, but may have varying lengths, as described in greater detail below in conjunction with the embodiment shown in FIG. 3.

As seen in FIG. 2, the struts 42 are hollow struts having channels 48 therethrough with inlets 50 on the outside of the tubular body 22 of the flow diffuser 20 and outlets 52 in or near the exit plane 34 of the flow diffuser 20. These inlets 50 and outlets 52 allow for the struts 42 to draw ambient air into the exhaust stream as a result of the pressure differential between the environment outside the diffuser 20 and the environment inside the diffuser 20, such that the ambient air aids in heat dissipation of the exhaust stream. The struts 42 include tapered inlets 50 to enhance the flow of ambient air into the channels. The outlets 52 are spaced from the inlets 50 along the length of the struts 42 in or near the exit plane 34. In that regard, the outlets 52 are suitably spaced in the exhaust stream to aid in heat dissipation. As mentioned above, one drawback of prior art diffusers is that they passively feed ambient air directly through the duct walls, but do not optimally intermingle the ambient air with the hot core streams in the center of the exhaust pipes.

Figure 6:
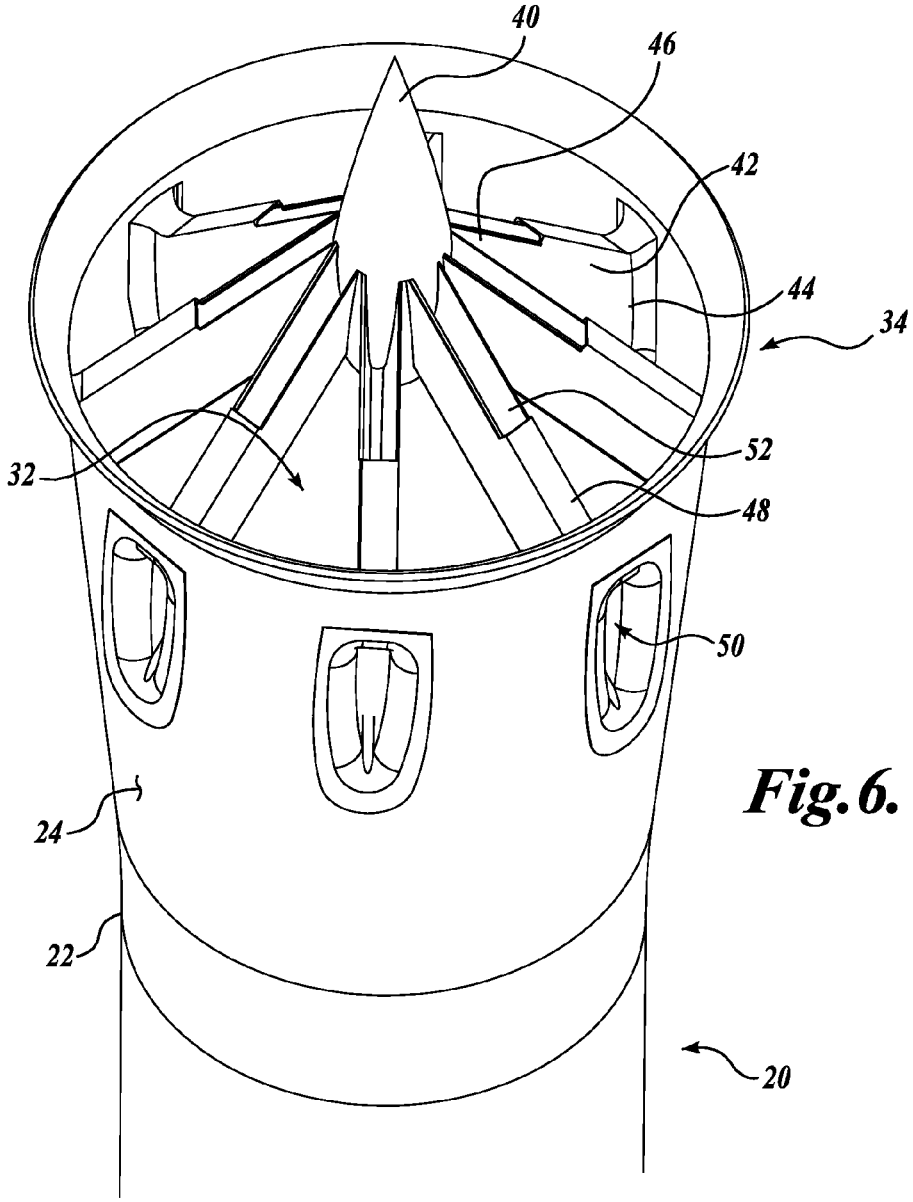
FIGS. 6 and 7 are perspective views of the flow diffuser formed in accordance other embodiments of the present disclosure.
Figure 7:
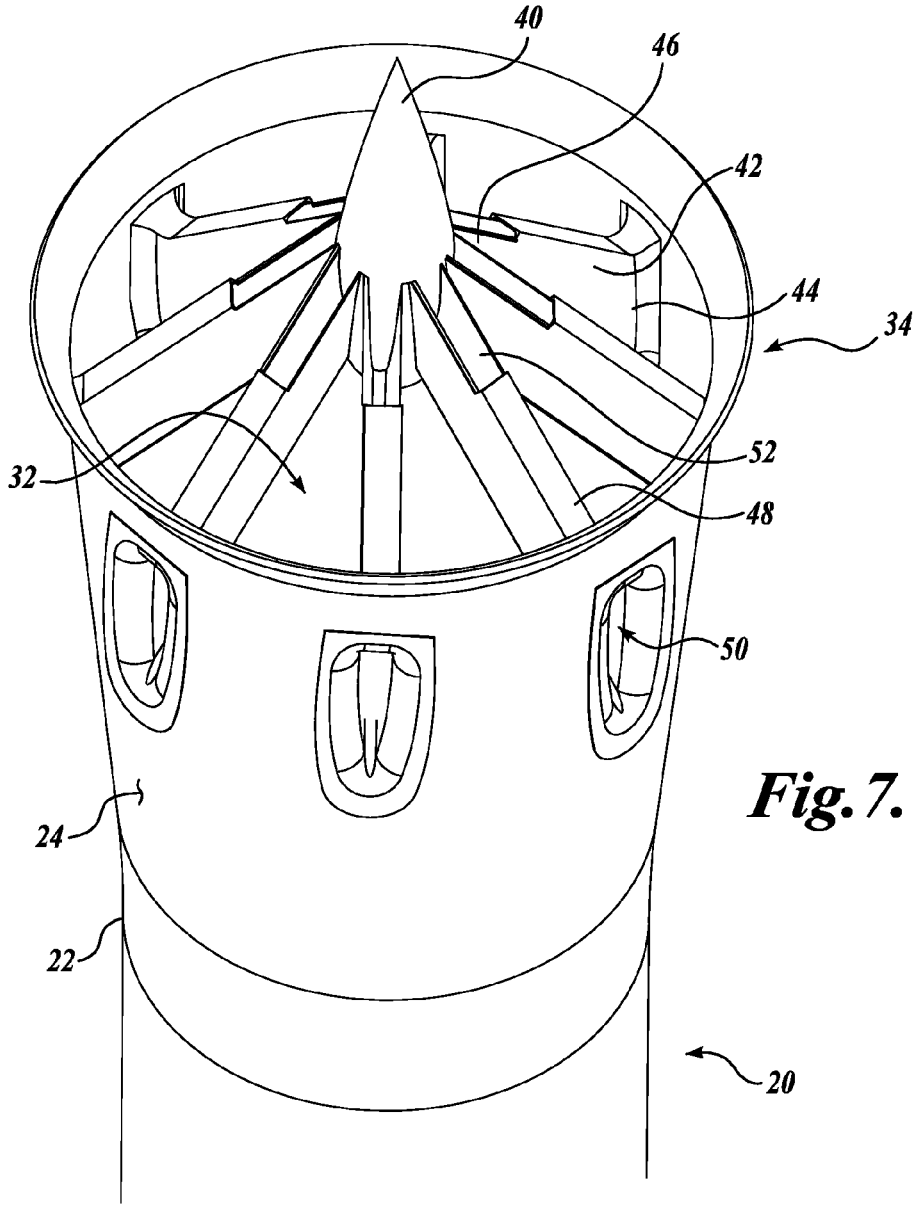

In view of these deficiencies, the struts 42 and the outlets 52 in the struts 42 of the present disclosure are designed to optimally mix ambient air in the hot core of the exhaust stream. In one embodiment of the present disclosure, the outlets 52 are located in the interior of the tubular body 22 at least ¼ of the radial distance inwardly from the outer wall 24 of the tubular body 22. In another embodiment of the present disclosure, the outlets 52 are located in the interior of the tubular body 22 at least ⅓ of the radial distance inwardly from the outer wall 24 of the tubular body 22. (See FIG. 6). In yet another embodiment of the present disclosure, the outlets 52 are located in the interior of the tubular body 22 at least ½ of the radial distance inwardly from the outer wall 24 of the tubular body 22. (See FIG. 7).

In the illustrated embodiment, the outlets 52 are shown to be substantially equidistant from the inlets 50 along the length of the struts 42; however, it should be appreciated that the outlets 52 may be at varying positions along the length of the struts 42. In the illustrated embodiment, the outlets 52 mix ambient air with the exhaust stream in the direction of the exhaust stream. If the outlets 52 were facing the exhaust stream, then they would serve as inlets, with exhaust gases exiting along the outer surface 24 of the tubular body 22.

The heat transfer and fluid mixing promoted by the flow diffuser 20 of the illustrated embodiment of FIGS. 1 and 2 will now be described in greater detail. When in use, heat dissipation of hot exhaust gas is achieved through the flow diffuser 20 in at least four ways: (1) by heat conduction; (2) by velocity reduction; (3) by breaking up the exhaust stream to encourage turbulence and mixing with ambient air; and (4) by introducing ambient air into the exhaust stream. As will be described in greater detail below, velocity reduction and mixing with ambient air, in turn, result in reduction of the center core of the hot exhaust gas streams exiting the flow diffuser 20 to promote enhanced fluid mixing upon exit. Enhanced fluid mixing results in more rapid heat dissipation of the exhaust gas with the surrounding ambient air. It should be appreciated that fluid mixing contributes more significantly to the overall heat dissipation of the flow diffuser 20 than heat dissipation by conduction (for example, heat loss through the outer surface 24 of the flow diffuser 20).

First, heat is dissipated from the effective surface area of the flow diffuser 20 to the surrounding ambient air. The wall thickness of the diffusion portion 30 and the substantially tubular body 22, as well as the thermal resistivity of the material from which the flow diffuser 20 is constructed, contribute to the conductive cooling achieved by the flow diffuser 20, in accordance with the principles of heat transfer. It should further be appreciated that additional cooling of the flow diffuser 20 surface may be achieved by convective cooling. For example, if the vehicle 10 to which the flow diffuser 20 is attached is moving, the fluid flow of the surrounding ambient air over the flow diffuser 20 will further provide cooling to the flow diffuser 20.

Second, because the flow area of the diffusion portion 30 may be greater than the flow area at the inlet or first end 26 of the flow diffuser 20, the velocity of the exhaust gas may decrease as it exits the diffusion portion 30. Decreased exhaust gas velocity allows for a decreased penetration distance of the jet exhaust streams, which further allows for enhanced mixing of the exhaust gas streams with the surrounding ambient air. In addition to the mixing advantages described herein, increased flow area at the diffusion portion 30 also helps decrease back pressure during the vehicle exhaust stroke.

Third and fourth, heat dissipation is promoted through breaking up the exhaust stream to encourage turbulence and mixing, as well as by introducing ambient air into the exhaust stream. With regard to the mixing effects, it should be appreciated that exhaust gas generally has a nonlaminar flow at a high velocity and, comparatively, the surrounding ambient air generally has a substantially quieter flow at a lower velocity. As the exhaust gas exits the flow diffuser 20, the flow diverter 40 (or plug) and flow dividers 42 (or struts) create a plurality of separate exhaust gas streams through separate diffusion ports 32.

Although the velocities of the separate exhaust gas streams decrease with increased flow area at or near the exit plane 34, the exhaust gas still exits the flow diffuser 20 at a substantially higher velocity than the surrounding ambient air. When the exhaust gas streams exit the flow diffuser 20, the shearing forces between the exhaust gas streams and the surrounding ambient air create a frictional drag at their barriers. This frictional drag creates a series of small vortices along the barriers of the exhaust gas streams, and the circulation of the vortices promotes mixing between the exiting streams and the surrounding ambient air to aid in the diffusion of the exhaust gas. Such mixing aids in significantly decreasing the temperature of the hot exhaust gas and the penetration distance of hot exhaust gas streams discharging from the flow diffuser 20.

The more barriers and vortices that are created and the more ambient air present at the barriers for mixing, the greater the heat diffusion of the exhaust gas. Therefore, the combination flow diversion and flow dividing, as well as the introduction of ambient air promotes increased mixing of the exhaust gas with ambient air after exiting the flow diffuser 20. In addition, if the vehicle 10 to which the flow diffuser 20 is attached is moving, the fluid mixing may be even more enhanced by the introduction of convective mixing principles, described above.

Referring to FIG. 2, the flow diverter 40 and the radial struts 42 divide the exhaust stream into a plurality of exhaust streams and create a series of barriers and vortices through the core of the exhaust stream. In addition, the channels 48 in the struts 42 draw ambient air into the core of the exhaust stream to provide a source of cooler air for mixing at the barriers and in the vortices.

Now returning to FIG. 3, a flow diffuser formed in accordance with another embodiment of the present disclosure will be described in greater detail. The flow diffuser is substantially identical in materials and operation as the previously described embodiment, except for differences regarding the diffusion portions of the flow diffusers, which will be described in greater detail below. For clarity in the ensuing descriptions, numeral references of like elements of the flow diffuser 20 are similar, but are in the 100 series for the illustrated embodiment of FIG. 3.

As mentioned above, the struts 142 may be configured in a variety of numbers and configurations to optimize heat dissipation at or near the exit plane 134 of the flow diffuser 120. In the illustrated embodiment of FIG. 3, the struts 142 and 162 are configured in an alternating long and short pattern to provide enhanced mixing and turbulence in the exhaust stream at the exit plane 134. In that regard, the long struts 142 extend to the longitudinal center axis of the flow diffuser 120, while the short struts 162 extend only a portion of the way in the radial direction into the flow diffuser 120. The advantage of this pattern is that the long and short struts 142 and 162 break up the exhaust stream to encourage turbulence and mixing, and also to introduce ambient into the exhaust stream at various radial distances. It should be appreciated that other patterns are also within the scope of the present disclosure, and varying strut length is also within the scope of the present disclosure.

EXAMPLE

Comparative Exhaust Temperature Section Plots

The heat transfer and fluid mixing promoted by the flow diffuser embodiments described herein may be further understood by referring to the exemplary temperature section plots of exhaust systems under simulated use conditions for modeling mass flow, inlet temperature, and exit port temperature of a diesel particulate filter undergoing regeneration.

Figure 4:
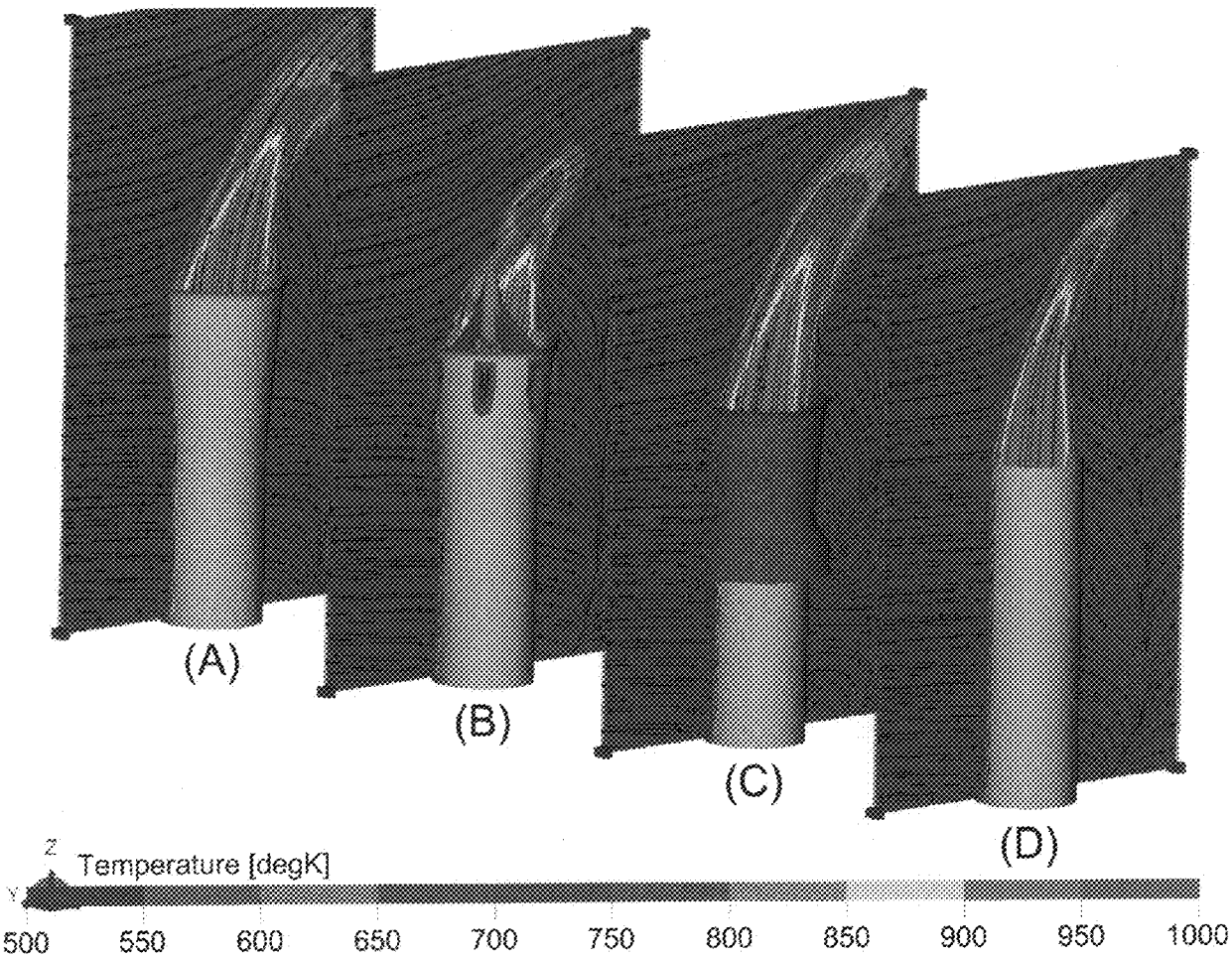
FIG. 4 is a comparison exit temperature section plot for four different systems (from left to right): an expanding tapered diameter exhaust pipe, the flow diffuser of FIG. 2, an intra-stream ambient injector, and a standard straight diameter exhaust pipe.

FIG. 4 includes comparison exit temperature section plots for four different systems (from left to right): (A) an expanding tapered diameter exhaust pipe, which corresponds for FIG. 5A; (B) the flow diffuser 20 of FIG. 2, which corresponds for FIG. 5B; (C) an intra-stream ambient injector, which corresponds for FIG. 5C; and (D) a standard straight diameter exhaust pipe, which corresponds for FIG. 5D. All four systems were subjected to simulated diesel particulate filter conditions of over 950 degrees Kelvin and a mass flow rate of about 1 kg/sec in a vertical stack application in a 20 mile/hr free stream. Ambient temperature is 273 degrees Kelvin.

Figure 5A:
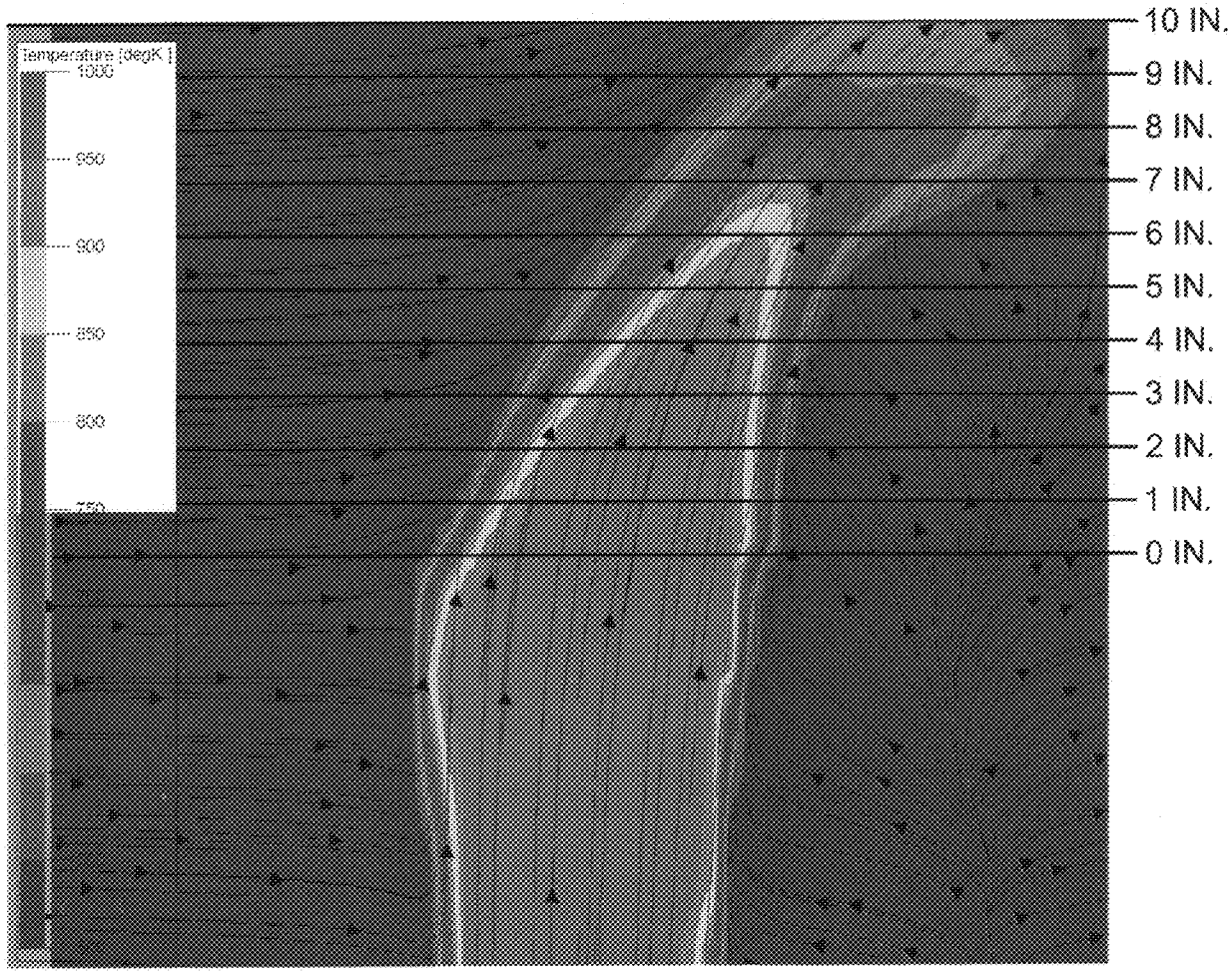
FIGS. 5A, 5B, 5C, and 5D are individual plots for the four systems of FIG. 4.
Figure 5B:
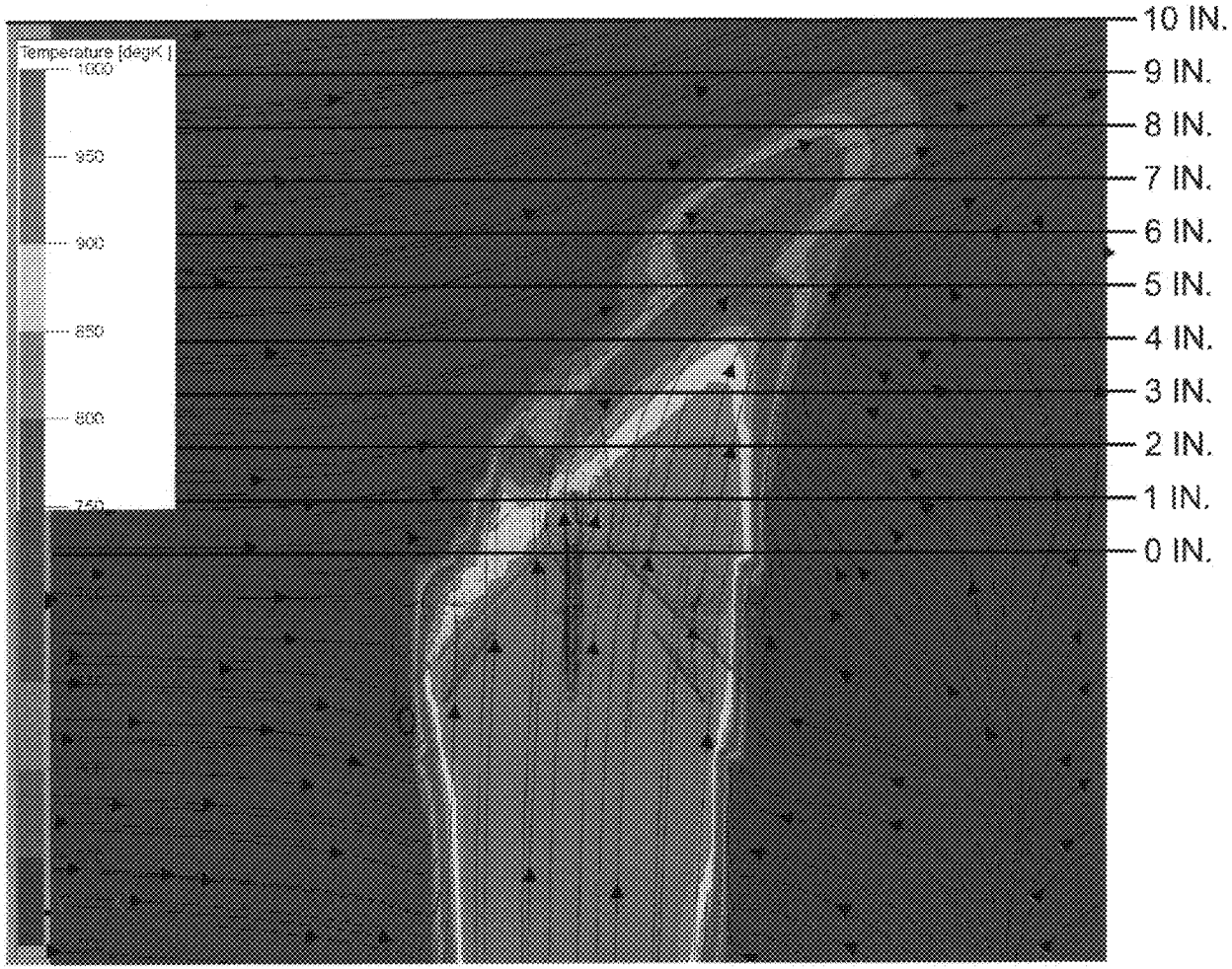
Figure 5C:
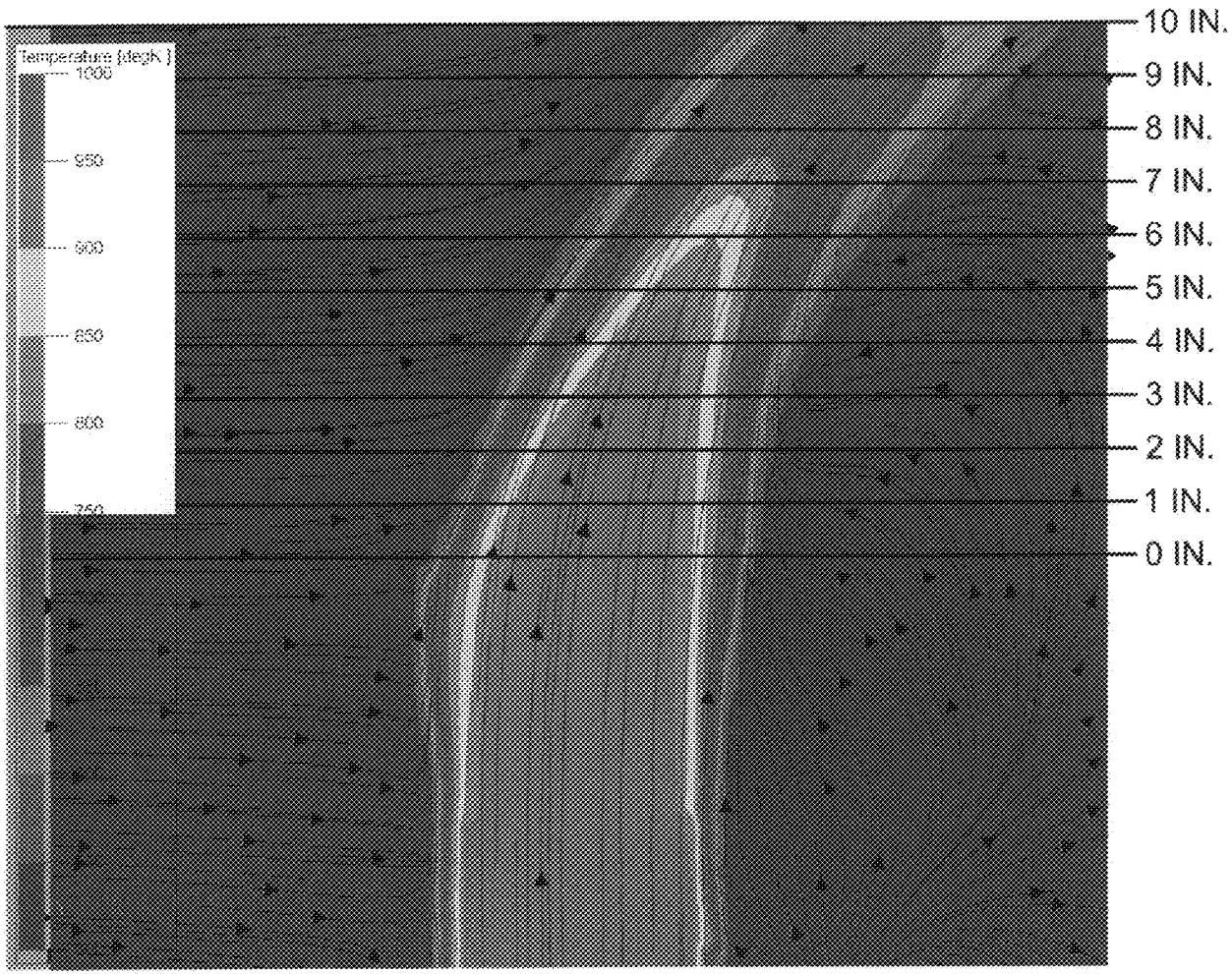
Figure 5D:
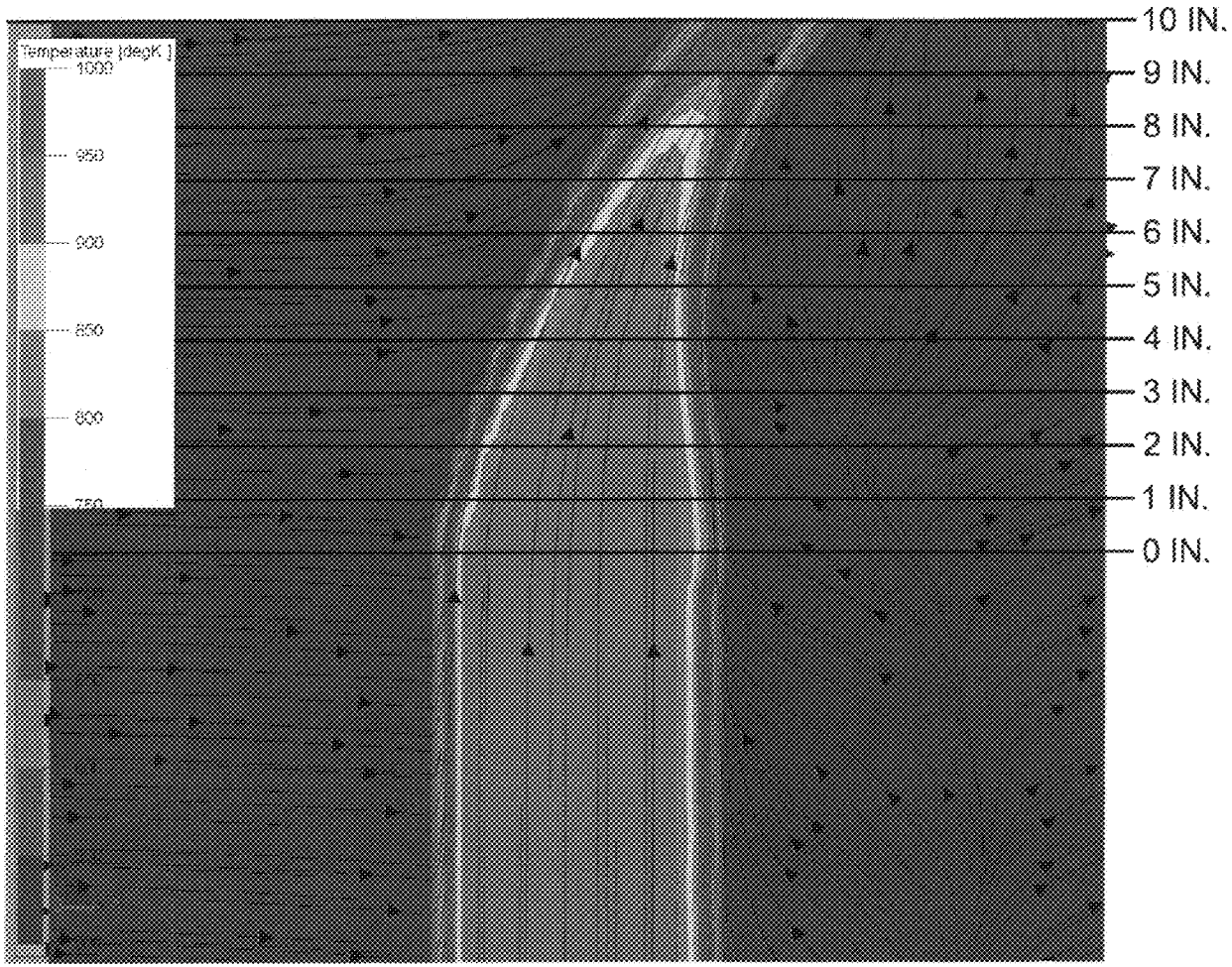

Referring to FIG. 5B, the hot core of the exhaust gas streams exiting the flow diffuser 20 has immediate heat dissipation from over 950 degrees Kelvin to less than about 850 degrees Kelvin within a vertical distance of less than about 4 inches from the exit plane 34 of the diffuser 20. Referring to FIG. 5D, the hot core of the exhaust gas stream exiting the standard exhaust pipe, on the other hand, has little to no heat dissipation from over 950 degrees Kelvin to less than 850 degrees Kelvin until the exhaust gas reaches a vertical distance of over 8 inches from the exit plane. Referring to FIGS. 5A and 5C, the hot cores of the exhaust gas streams exiting the expanding tapered diameter exhaust pipe and intra-stream ambient injector have little to no heat dissipation from over 950 degrees Kelvin to less than 850 degrees Kelvin until the exhaust gas reaches a vertical distance of over 6.5 inches from the exit plane.

Referring now to the comparison graph in FIG. 4, not only does the hot core dissipate more quickly using the flow diffuser 20 (see FIG. 5B), but the hot stream fully dissipates to ambient temperatures within a vertical distance of about 9 inches from the exhaust plane 34. All of the other systems have more gradual heat dissipation and do not achieve full heat dissipation until a vertical distance of well over 10 inches from the exhaust plane.

As best seen by comparing the temperature section plots in FIG. 4 for the flow diffuser 20 and the various other exhaust systems, the mixing effects of the flow diffusers formed in accordance with embodiments of the present disclosure are significantly improved over the mixing effects of the other systems as a result of the following: the combination of decreased exhaust stream velocity, resulting in improved mixing at the barrier; increased cross-sectional area at the exit plane of the flow diffuser, resulting in a reduced core in the exhaust gas streams and an increased barrier for the flow area for enhanced mixing; and the introduction of ambient air through the struts, resulting in a greater amount of ambient air at the barrier of the exhaust gas streams for enhanced mixing with ambient air.

Referring to FIG. 5D, by examining the limited expansion and mixing of the hottest core of the exhaust gas stream in the exit temperature section plot for a standard straight diameter exhaust pipe, the section plot indicates that significantly less mixing between the exhaust gas and the surrounding ambient air at the barrier is occurring, as compared to the mixing achieved with the flow diffuser 20 in FIG. 5B, described above. Less mixing at the standard exhaust pipe outlet is a result of the substantially constant velocity of the exhaust gas at the exhaust pipe inlet and outlet for a standard exhaust pipe having a circular cross section. Although the cross-sectional diameter of the hot spot decreases in diameter with vertical distance from the exit port, the hot spot remains a penetrating jet of hot exhaust gas, even after traveling a vertical distance of over 8 mm from the exit plane.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. In a land vehicle of the type having an engine and an exhaust system including an exhaust pipe, a flow diffuser for the exhaust pipe, the flow diffuser comprising:

(a) a tubular body having an outer wall, an interior, and first and second ends, the first end being an exhaust inlet configured to be attachable to an exhaust pipe, the second end being an exhaust discharge portion having an exit plane;

(b) a plurality of radial struts extending inwardly from the inner surface of the outer wall to the center of the exit plane for dividing the exhaust discharge portion divided into a plurality of exit channels, wherein each of the plurality of struts has a first and end, a second end, a length, and an inner channel, extending, through the strut along at least a portion of the length; and (c) a plurality of holes extending through the outer wall to the interior of the tubular body configured for delivering air to the interior of the tubular body, wherein at least some of the plurality of holes interface with the plurality of struts, such that the plurality of holes form a plurality of inlets to the inner channels extending through the plurality of struts on the outer wall of the tubular body at the first ends of the plurality of struts, and wherein a plurality of outlets are spaced from the inlets along the lengths of the plurality of struts and internal to the tubular body.

2. The flow diffuser of claim 1, further comprising a flow diverter coupled to at least one of the plurality of radial struts.

3. The flow diffuser of claim 2, wherein the flow diverter is centered in the tubular body near the exit plane.

4. The flow diffuser of claim 1, where the flow diffuser includes at least four struts.

5. The flow diffuser of claim 1, where the flow diffuser includes at least eight struts.

6. The flow diffuser of claim 1, wherein the struts are alternating long and short struts.

7. The flow diffuser of claim 1, wherein the tubular body has a larger cross-sectional area at the second end than at the first end.

8. The flow diffuser of claim 1, wherein the plurality of outlets are located in the interior of the tubular body, wherein a first end of each of the plurality of outlets is located at least ¼ of the radial distance inwardly from the outer wall of the tubular body.

9. The flow diffuser of claim 1, wherein the plurality of outlets are located in the interior of the tubular body, wherein a first end of each of the plurality of outlets is located at least ⅓ of the radial distance inwardly from the outer wall of the tubular body.

10. The flow diffuser of claim 1, wherein the plurality of outlets are located in the interior of the tubular body, wherein a first end of each of the plurality of outlets is located at least ½ of the radial distance inwardly from the outer wall of the tubular body.

11. In a land vehicle of the type having an engine and an exhaust system including an exhaust pipe, a flow diffuser for the exhaust pipe, the flow diffuser comprising:

(a) a tubular body having an outer wall, an interior, and first and second ends, the first end being an exhaust inlet configured to be attachable to an exhaust pipe, the second end being an exhaust discharge portion having an exit plane, wherein the outer wall includes a plurality of holes extending therethrough;

(b) a plurality of radial struts extending inwardly from the inner surface of the outer wall to the center of the exit plane for dividing the exhaust discharge portion divided into a plurality of exit channels, wherein each of the plurality of radial struts has a first-end, a second end, a length, and an inner channel extending through the strut along at least a portion of the length, wherein each of the inner channels extend from an inlet at the first end that interfaces with a hole on the outer surface of the outer wall to an outlet along the length of the strut in the interior of the tubular body.

12. In a land vehicle of the type having an engine and an exhaust system including an exhaust pipe, a flow diffuser for the exhaust pipe, the flow diffuser comprising:

(a) a tubular body having an outer wall, an interior, and first and second ends, the first end being an exhaust inlet configured to be attachable to an exhaust pipe, the second end being an exhaust discharge portion having an exit plane, wherein the outer wall includes a plurality of holes extending therethrough;

(b) a plurality of radial struts extending inwardly from the inner surface of the outer wall to the center of the exit plane for dividing the exhaust discharge portion divided into a plurality of exit channels, wherein each of the plurality of radial struts has a first end, a second end, a length, and an inner channel extending through the strut along at least a portion of the length, wherein each of the inner channels extend from an inlet at the first end that interfaces with a hole on the outer surface of the outer wall an outlet along the length of the strut in the interior of the tubular body, wherein the outlets are located in the interior of the tubular body at least ¼ of the radial distance inwardly from the outer wall of the tubular body.

* * * * *